US007703576B2

(12) United States Patent
Grabowski

(10) Patent No.: US 7,703,576 B2
(45) Date of Patent: Apr. 27, 2010

(54) FIRE ESCAPE APPARATUS

(76) Inventor: Richard Grabowski, 98 Governor St., New Britain, CT (US) 06053

( * ) Notice: Subject to any disclaimer, the term of this patent is extended or adjusted under 35 U.S.C. 154(b) by 700 days.

(21) Appl. No.: 11/581,804

(22) Filed: Oct. 17, 2006

(65) Prior Publication Data

US 2008/0087494 A1 Apr. 17, 2008

(51) Int. Cl.
*E06C 9/14* (2006.01)

(52) U.S. Cl. ..... 182/82; 182/3; 182/36

(58) Field of Classification Search ..... 182/82, 182/36, 70, 3

See application file for complete search history.

(56) References Cited

U.S. PATENT DOCUMENTS

| | | | | | |
|---|---|---|---|---|---|
| 204,581 | A * | 6/1878 | Knight et al. | 182/43 |
| 607,161 | A * | 7/1898 | Conaway | 182/82 |
| 670,222 | A * | 3/1901 | Campbell | 366/9 |
| 3,779,227 | A * | 12/1973 | Scott | 124/16 |
| 3,944,021 | A * | 3/1976 | Smith et al. | 182/3 |
| 4,038,508 | A * | 7/1977 | Mapelsden | 200/329 |
| 4,125,172 | A * | 11/1978 | Hatala | 182/19 |
| 4,207,965 | A * | 6/1980 | Chiang-Cheng et al. | 182/13 |
| 4,264,213 | A * | 4/1981 | Dillman | 366/9 |
| 4,267,900 | A * | 5/1981 | Yin-Lung | 182/13 |
| 4,295,543 | A * | 10/1981 | Graham | 182/3 |
| 4,466,507 | A * | 8/1984 | Itano | 182/3 |
| 4,709,782 | A * | 12/1987 | Lipinski | 182/3 |
| 5,649,607 | A * | 7/1997 | Chang et al. | 182/82 |
| 6,830,126 | B2 * | 12/2004 | Godwin | 182/82 |
| 2002/0088910 | A1 * | 7/2002 | Sweere et al. | 248/286.1 |
| 2003/0070874 | A1 * | 4/2003 | Kim | 182/82 |

* cited by examiner

*Primary Examiner*—Katherine W Mitchell
*Assistant Examiner*—Daniel Cahn
(74) *Attorney, Agent, or Firm*—Ted Paulding

(57) ABSTRACT

Fire escape apparatus comprising a main elongated hollow tubular member with an elongated slot and a relatively short auxiliary tubular member of similar construction. The main member is mounted on an exterior building wall and the auxiliary member extends therefrom to a building opening such as a door or window. A spherical member at the end of a flexible connecting line running to a building occupant is entered in the auxiliary tubular member and is controlled in its descent by frictional engagement with gradually arcuate spring-like members.

9 Claims, 6 Drawing Sheets

FIRE ESCAPE APPARATUS

FIELD OF THE INVENTION

This invention relates to a fire escape apparatus of the type used in multi-story buildings permitting building occupants to descend from locations above the ground floor in a safe and secure manner in order to avoid inhaling smoke and suffering burns from the fire.

BACKGROUND OF THE INVENTION

Permanently installed fire escapes of the type which include steel stairways are of course quite expensive. Simplified devices of various types available in the past have been generally successful but have been found lacking in simplicity of construction, ease and convenience of use, and in some cases have failed in providing safe descent of occupants from a burning building.

The general object of the present invention is to provide a fire escape apparatus which is of simple construction which may be manufactured at economic advantage and which provides a high degree of safety in use by building occupants.

BACKGROUND OF THE INVENTION

In accordance with the present invention and in fulfillment of the foregoing object, a main elongated hollow tubular member is provided with an elongated slot opening through its sidewall substantially throughout its length. The member is mounted vertically on a building exterior wall adjacent to at least one opening such as a door or window above the ground floor. At least one relatively short hollow auxiliary tubular member open at opposite ends and with a slot opening though its side is mounted on the building exterior with one end adjacent the door or window opening and the other end adjacent the main tubular member. The intermediate portion of the member is inclined downwardly from the door or window to the main tubular member. An opening in the wall of the main tubular communicates with the interior of the auxiliary member at its lower end and the slots of the two members also communicate. The upper end of the auxiliary member is positioned within reach of an occupant of the building attempting to escape the door or window. Both the main and auxiliary tubular members have first braking means in their interior substantially throughout their length and a second braking means co-operable with the first braking means is also provided. A connecting device extends from the second braking means to the occupant enabling the latter to activate the two cooperating braking means and slowly and safely descend to the ground.

The first and second braking means are important aspects of the invention and respectively comprise a series of gradually arcuate spring members arranged generally in opposing pairs on opposite interior surfaces of the tubular members and a spherical member dimensioned to engage and pass between the spring members in a frictionally restrained downward movement at a predetermined safe rate of speed.

The tubular members each take a generally rectangular cross-sectional configuration with interior dimensions serving to substantially center the spherical member between the spring like members and to insure positive engagement therebetween.

Preferably, the spherical members are provided with a plurality of size-adjusting elements to accommodate building occupants of varying weight.

The connecting means between the spherical member and the occupant may be held manually by the occupant but in a preferred embodiment a harness is provided for the occupant and is readily attachable to a connecting means.

DESCRIPTION OF THE PREFERRED EMBODIMENT

Figure 4:
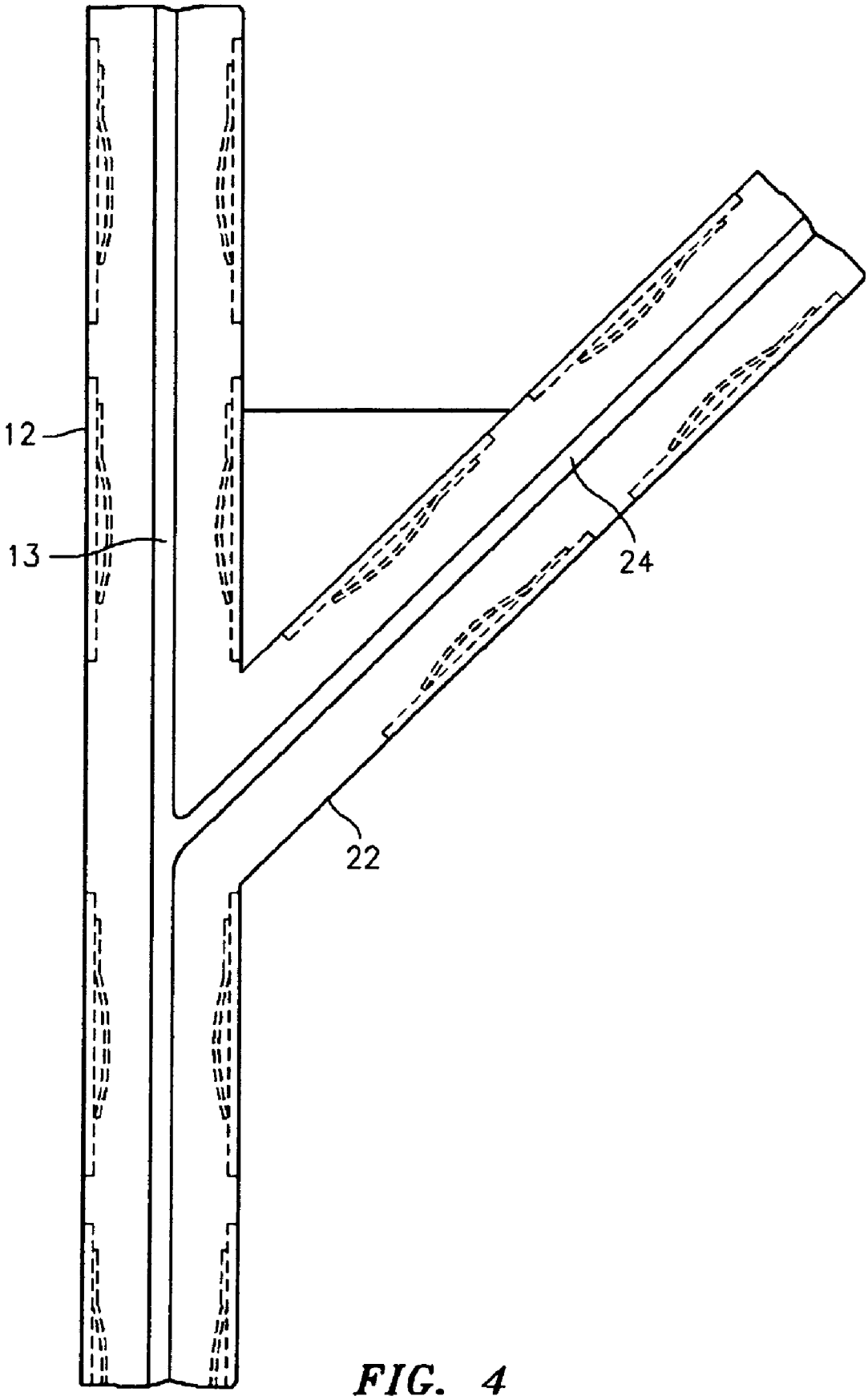
FIG. 4 is a fragmentary view of a main tubular member at its junction with an auxiliary tubular member.
Figure 5:
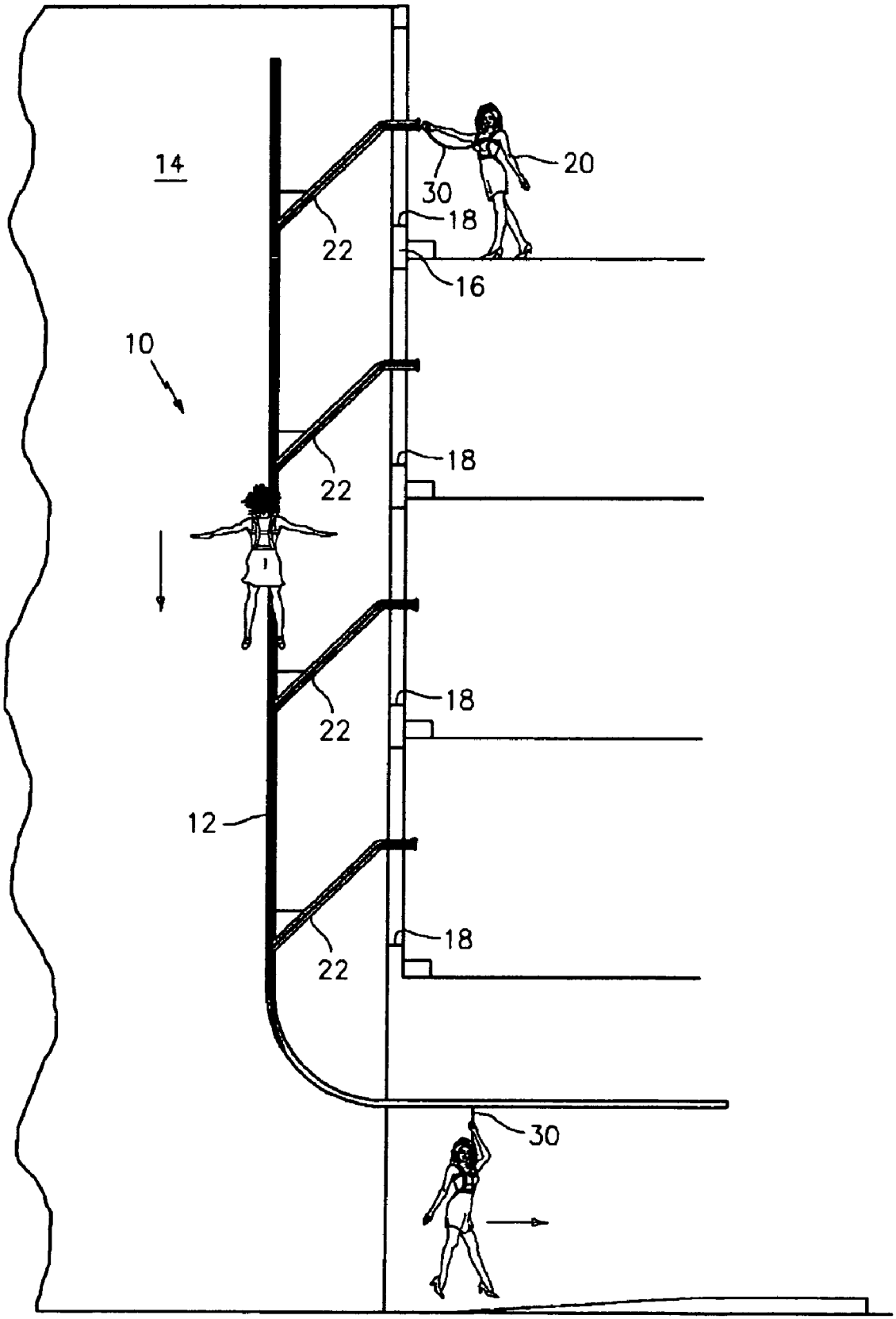
FIG. 5 is an overall elevation of the fire escape apparatus of the invention showing the manner in which a building occupant may descend safely and securely thereon.

Referring to FIGS. 4 and 5 in particular, an improved fire escape apparatus is indicated generally at 10 and includes a main elongated hollow tubular member 12 which has an elongated slot 13 opening through its side wall substantially throughout its length. The tubular member is shown mounted on a building wall 14 which joins a second wall 16 at right angles. The wall 16 has openings 18,18 which may be doors or windows and which may serve as escape routes for building occupants such as an occupant 20 on the $5^{th}$ floor. The building shown has five (5) floors but this of course may vary widely.

Relatively short hollow auxiliary tubular members 22,22 are shown extending angularly upwardly to the building openings 18,18 from the main tubular member 12. The auxiliary members 22,22 are substantially identical to the main tubular member 12 and are also provided with slots 24,24 as best illustrated in FIG. 4. At their lower ends the tubular member 22,22 communicate with the interior of the main tubular member 10 and at their upper ends the members 22,22 open near or at the building openings 18,18 so as to be easily accessed by a building occupant trying to escape a fire. The slots 13,13 and 24,24 also communicate at the junctions between the main and auxiliary tubular members.

Figure 1:
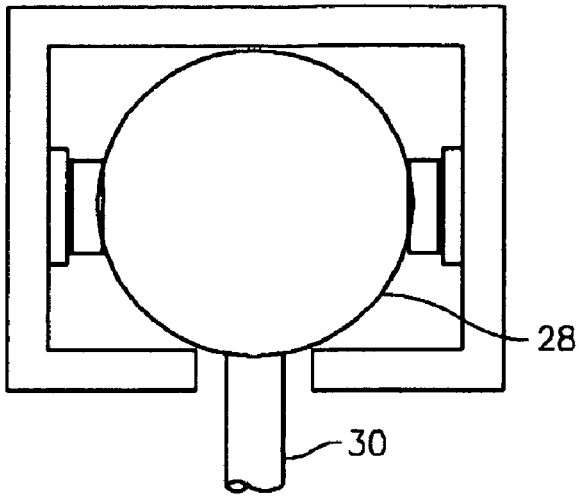
FIG. 1 of the drawings is a top view of a tubular member of the invention with first and second braking means shown therein.
Figure 2:
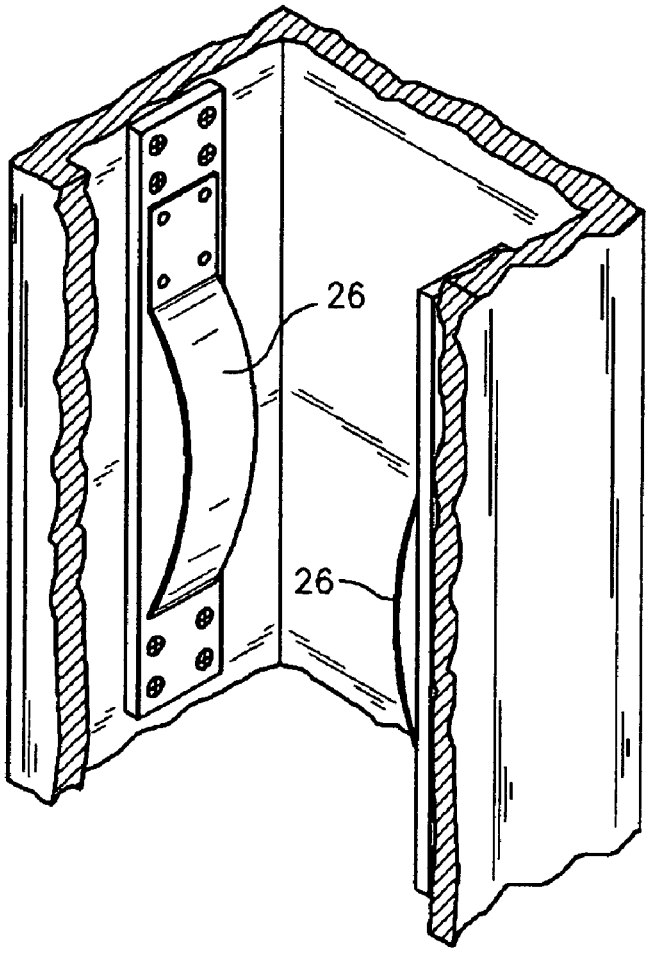
FIG. 2 is a perspective view of the tubular member with portions broken away for clarity of illustration.
Figure 3:
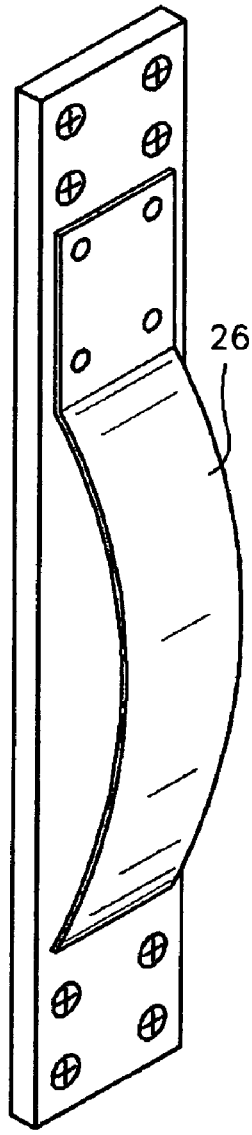
FIG. 3 is an enlarged perspective view of a first braking means comprising a gradually arcuate spring-like member.

Both the main and auxiliary tubular members are provided with a first braking means in accordance with the invention. As best illustrated in FIGS. 1-3, gradually arcuate spring members 26,26 are arranged in opposing relationship in the interior of the tubular members. More specifically, the members 26,26 take the form of arcuate leaf springs secured at their upper ends to the walls of the tubular members but free at their lower ends to accommodate flexing of the same by a second braking means in the form of a sphere 28. The sphere 28 engages the springs 26,26 in downward passage through the tubular members and is frictionally restrained thereby to control the rate of descent of a building occupant as will be more fully explained herein-below. In order to be certain that firm engagement is provided for, the tubular members are constructed with a rectangular cross sectional configuration and the relative dimensions of the sphere and the tubular members are carefully calculated to maintain the desired position of the sphere relative to the springs.

Figure 6:
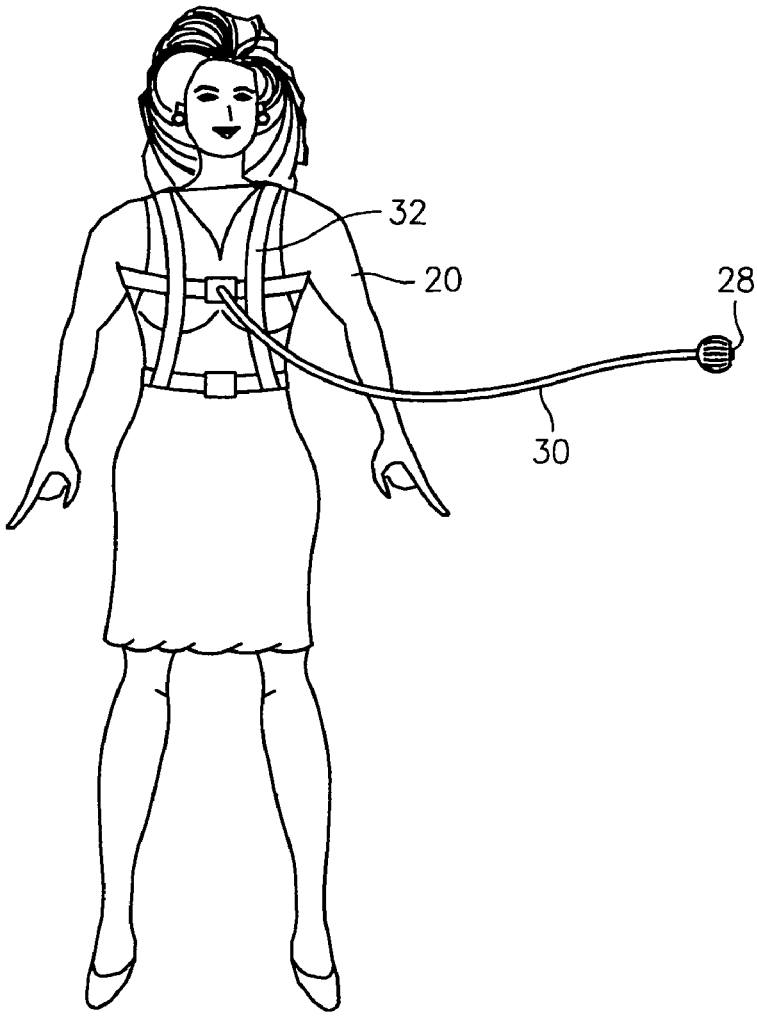
FIG. 6 is a schematic rendering of a building occupant fitted with a harness usable with the fire escape apparatus.
Figure 7:
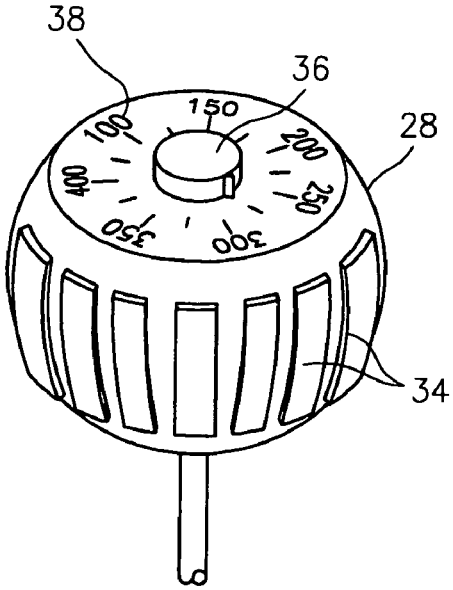
FIG. 7 is a perspective view of an adjustable spherical member comprising the second braking means of the apparatus.
Figure 8:
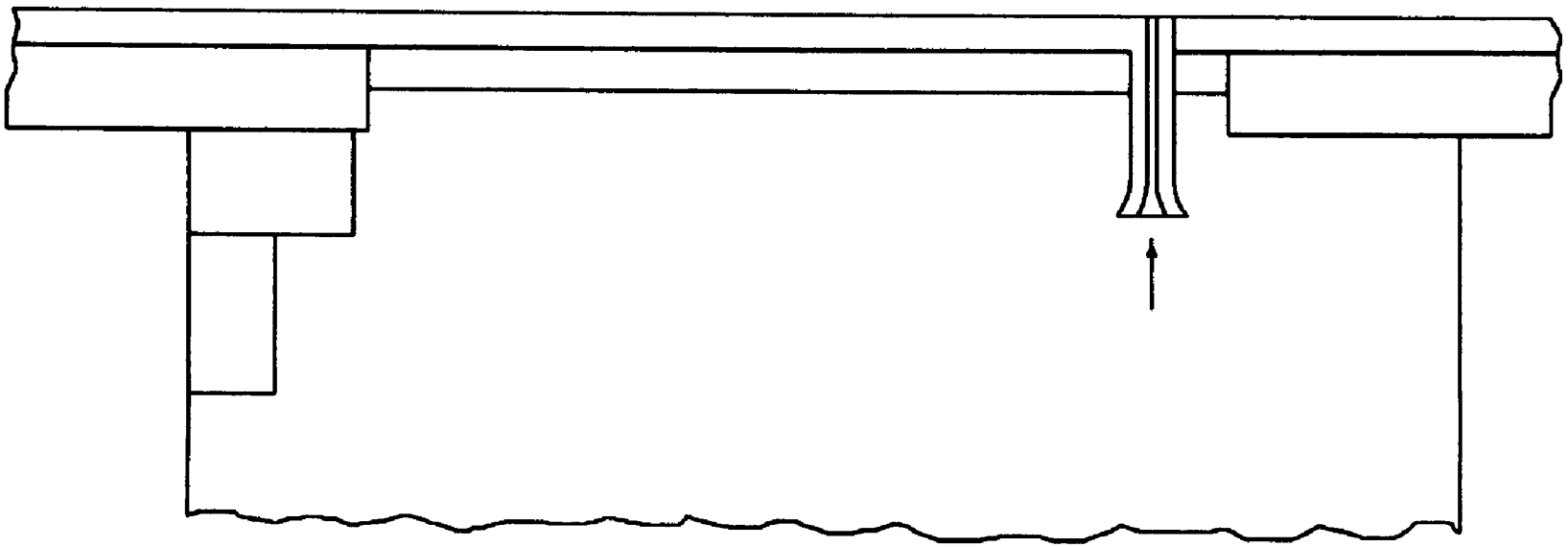
FIG. 8 is an enlarged view of an opening in a building wall and an associated portion of an auxiliary tubular means.
Figure 9:
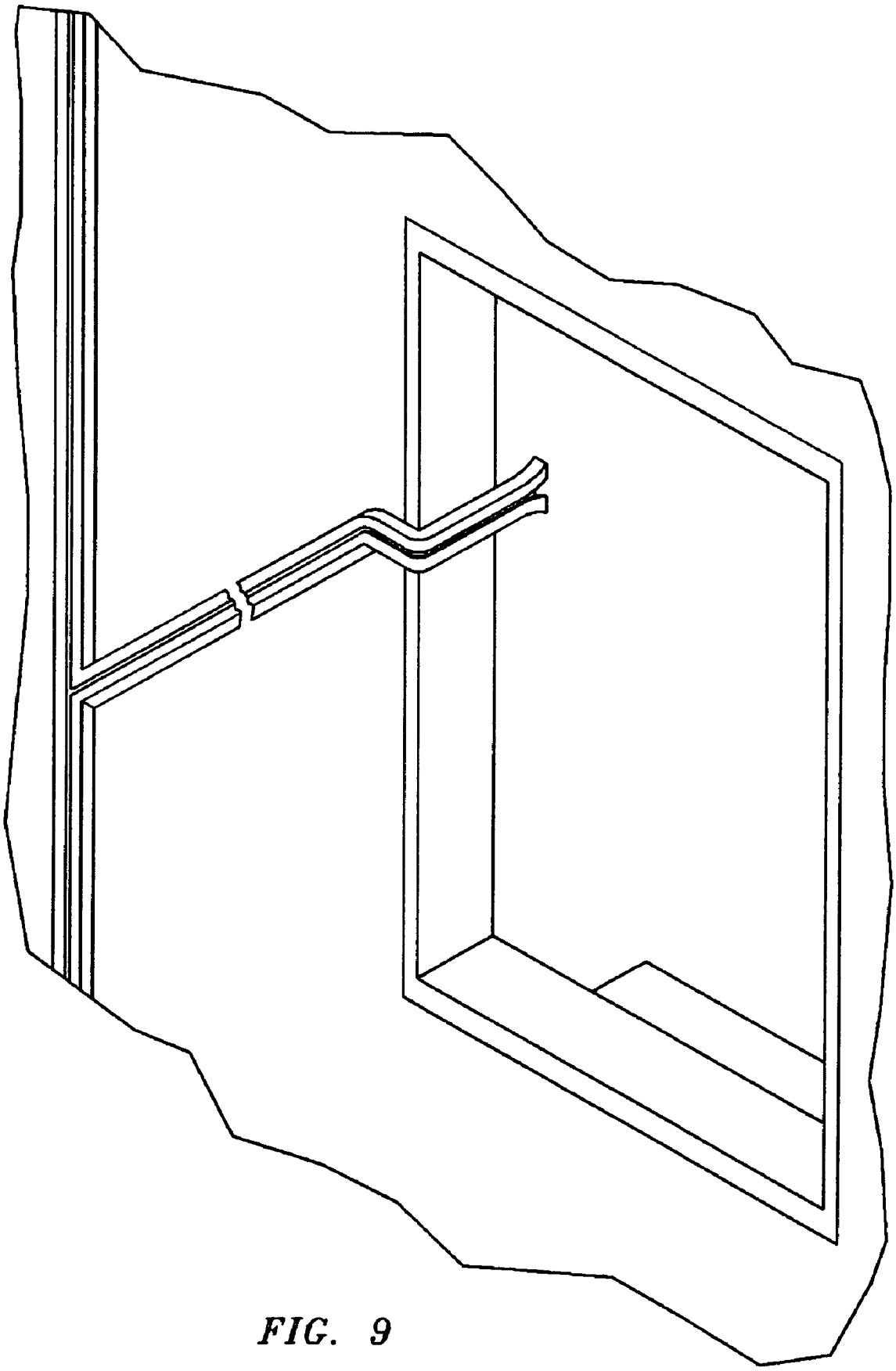
FIG. 9 is an perspective of an opening in a building wall and an associated auxiliary tubular member forming a part of the fire escape apparatus.

Referring now to FIGS. 5 and 6, it will be seen that a connecting device from the building occupant and the second braking means or sphere 28 may take the form of a flexible cord 30. Handles or other means may be provided but for maximum safety a harness 32 is preferred. The harness 32 may vary in form but should of course be of light weight and high strength construction.

Finally, the sphere 28 is preferably provided with adjustable means for controlling the rate of descent of occupants of varying weight. Movable elements 34,34 projecting through the surface of the sphere may be spring biased and cam operated internally by means not shown under the control of a knob 36 prior to use. Dial 38 assists the occupant in finding a correct setting.

As will be apparent from the foregoing, the fire escape apparatus of the invention is of relatively simple construction and may be constructed at a reasonable cost. In use the apparatus is easily installed and does not interfere with the aesthetics of the building providing simple clean lines. In the event of fire, occupants of the building may escape quickly and safely in sequence, a supply of harnesses and connecting devices being provided near doors and windows equipped with the apparatus.

The invention claimed is:

1. A fire escape apparatus comprising a main elongated hollow tubular member having an elongated slot opening through a side wall substantially throughout a length of the main tubular member, said tubular member being adapted for mounting vertically on a building exterior wall adjacent at least one of a door or window opening above a ground floor and extending from one of the door or window openings to the ground, at least one short hollow auxiliary tubular member having opposite ends open and a slot opening through a side wall of the auxiliary tubular member, said auxiliary tubular member being adapted for mounting on the building exterior wall with one end adjacent one of said door and window openings a second end adjacent an upper end of the main tubular member, an intermediate portion of the auxiliary tubular member being declined downwardly from the door or window to the main tubular member, the main tubular member having an opening at an upper end communicating with an interior of the auxiliary tubular member at a lower end of the auxiliary tubular member and the slots of the auxiliary and main tubular members also communicating, an upper end of the auxiliary member being within reach of an occupant of the building attempting to escape through the door or window opening, both the main and auxiliary tubular members having first braking means comprising a series of gradually arcuate spring members in opposing pairs on opposite interior surfaces of the auxiliary and main tubular members substantially throughout the length of the main tubular member and a length of the auxiliary tubular member, a second braking means co-operable with the first braking means where the second braking means is also disposed within the auxiliary or main tubular members, the second braking means taking the form of a size adjustable spherical member dimensioned to engage and to be frictionally restrained in passage between the spring members while the second braking means is in downward movement at a predetermined safe rate of speed, a connecting device extending from the second braking means outwardly through the auxiliary or main tubular member slots and connecting to an occupant of the building enabling the occupant to activate the two braking means and slowly and safely descend to the ground in a smooth linear path of downward movement.

2. A fire escape apparatus as set forth in claim 1 wherein said building has a plurality of generally vertically aligned openings, and wherein said apparatus includes a plurality of auxiliary tubular members associated respectively with the openings.

3. A fire escape apparatus as set forth in claim 1 wherein said auxiliary tubular member is bent at its upper end to at least partially enter an opening in the wall of the building.

4. A fire escape apparatus as set forth in claim 1 wherein said main tubular member takes a gradual bend adjacent to the ground and extends horizontally for safe landing of the occupant.

5. A fire escape apparatus as set forth in claim 1 wherein the spring members are arranged in the auxiliary and main tubular members with the spring members having upper ends fixed to the auxiliary and main tubular members and the spring members having lower ends free.

6. A fire escape apparatus as set forth in claim 1 wherein the auxiliary and main tubular members take a generally rectangular cross-sectional configuration with interior dimensions serving to substantially center the spherical member between the spring members and to ensure positive engagement therebetween.

7. A fire escape apparatus as set forth in claim 1 wherein the connecting device extends from the second braking means to the building occupant is flexible and is manually manipulable by a building occupant to enter the second braking means in the upper open end of one of the auxiliary tubular members with the connecting device passing through the slot of the auxiliary member.

8. A fire escape apparatus as set forth in claim 1 wherein a harness is provided for the building occupant and is readily attachable to the connecting device.

9. A fire escape apparatus comprising a main elongated hollow tubular member having an elongated slot opening through a side wall substantially throughout a length of the main tubular member, said main tubular member being adapted for mounting vertically on a building exterior wall adjacent at least one of a door or window opening above a ground floor and extending from one of the door or window openings to the ground, at least one short hollow auxiliary tubular member having opposite ends open and a slot opening through a side wall of the auxiliary tubular member, said auxiliary tubular member being adapted for mounting on the building exterior wall with one end adjacent one of said door and window openings and a second end adjacent the main tubular member, an intermediate portion of the auxiliary tubular member being declined downwardly from the door or window to the main tubular member, the main tubular member having an opening communicating with an interior of the auxiliary member at a lower end of the auxiliary tubular member and the slots of the auxiliary and main tubular members communicating, and an upper end of the auxiliary tubular member being within reach of an occupant of the building attempting to escape through the door or window, both the main and auxiliary tubular members having first braking means comprising a series of gradually arcuate spring members in opposing pairs on opposite interior surfaces of the auxiliary and main tubular members substantially throughout the length of the main tubular member and a length of the auxiliary tubular member, a second braking means co-operable with the first braking means where the second braking means is also disposed within the auxiliary or main tubular members, the second braking means taking the form of a spherical member dimensioned to engage and to be frictionally restrained in passage between the spring members while the second braking means is in downward movement at a predetermined safe rate of speed, a connecting device extending from the second braking means outwardly through the slot of the auxiliary or main tubular members to an occupant of the building enabling the occupant to activate the two braking means and slowly and safely descend to the ground in a smooth linear path of movement, wherein the spherical member is provided with a plurality of size adjusting elements to accommodate building occupants of varying weight.

* * * * *